United States Patent [19]

Overfelt et al.

[11] Patent Number: 4,983,230

[45] Date of Patent: Jan. 8, 1991

[54] PLATINUM-COBALT ALLOY PERMANENT MAGNETS OF ENHANCED COERCIVITY

[75] Inventors: Ruel A. Overfelt, Murfreesboro, Tenn.; John A. Teubert, Huntsville, Ala.

[73] Assignee: Vanderbilt University, Nashville, Tenn.

[21] Appl. No.: 336,041

[22] Filed: Apr. 11, 1989

[51] Int. Cl.[5] ..... H01F 1/047

[52] U.S. Cl. ..... 148/300; 148/430; 420/466

[58] Field of Search ..... 148/300, 306, 430; 420/466

[56] References Cited

U.S. PATENT DOCUMENTS 4,221,615 9/1980 Shine ..... 148/300
4,764,435 8/1988 Hosizaki et al. ..... 420/466

OTHER PUBLICATIONS

Becker et al., IEEE Transactions on Magnetics, (1984), MAG-20, 5:1596-1598.

Anderson et al., Materials Research Soc. Proceedings, (1987), 80:449-456.

Livingston, Proc. 8th Intl. Workshop on Rare Earth Magnets, ed. K. J. Strnat, (1985), pp. 423-440.

Katada and Shimizu, J. Appl. Physics, (1983), 54(12):7089-7094.

Vanderbilt University Center for the Space Processing of Engineering Materials, Nashville, Tenn., Annual Report of Oct. 1, 1985 to Oct. 31, 1986, pp. 30-38.

*Primary Examiner*—John P. Sheehan

*Attorney, Agent, or Firm*—Tilton, Fallon, Lungmus & Chestnut

[57] ABSTRACT

The coercivity of magnetic alloys formed from platinum, cobalt, and boron is enhanced by incorporating from 12 to 14 percent of boron together with amounts of platinum and cobalt such that the ratio of platinum to cobalt is from 0.90 to 1.2. The magnetic alloy is formed by rapid solidification of a homogeneous melt, and the solidified casting is heat treated to improve microstructure and increase coercivity.

7 Claims, 1 Drawing Sheet

PLATINUM-COBALT ALLOY PERMANENT MAGNETS OF ENHANCED COERCIVITY

GRANT SUPPORT

This research was partially supported by the National Aeronautics and Space Administration under Contract NAGW-810.

FIELD OF INVENTION

This invention relates to permanent magnets prepared from alloys of platinum and cobalt, and particularly to platinum-cobalt alloys which contain approximately equal amounts of these metals.

BACKGROUND OF INVENTION

Permanent magnets based on the near equiatomic composition of PtCo have been the magnets of choice in applications where large energy products, corrosion resistance, and fracture toughness are primary design considerations. (See, Newkirk, et al., *Transactions AIME*, 1950, 188, 1249; and Wohlfarth, *Advances in Physics*, 1959, 8, 208.) PtCo type magnets were studied and developed in the period from 1950 to 1970. (See Craik, *Platinum Metals Review*, 1969, 13, 95.) Very little research has been reported in recent years.

In the manufacture of PtCo magnets, rapid solidification processing is employed to produce a refined microstructure. Extended solubilities and metastable phases often result in interesting and useful magnetic properties, as described by Overfelt, et al., *IEEE Transactions on Magnetics*, 1984, MAG-20, for an $Fe_{77}Nd_{15}B_8$ alloy. A reduction in grain size occurs when the alloy melt is rapidly solidified. (See Anderson, et al., *Materials Research Soc. Proceedings*, 1987, 80, 449; and Livingston, *Proc. 8th Intl. Workshop on Rare Earth Magnets*, ed. K. J. Strnat, 1985, 423.) Katad and Shimizu found coercivities as high as 1.8 kOe in sputtered thin films of $Pt_{20}Co_{80}$, and confirmed the correlation between coercivity and grain size: *J. Appl. Phys.*, 1983, 54 (12), 7089.

In recent years, the properties of platinum-cobalt magnetic alloys produced by rapid solidification have been studied at the Vanderbilt University Center for the Space Processing of Engineering Materials, Nashville, Tenn.. Preliminary results of these investigations are contained in an Annual Report of Oct. 1, 1985 to Oct. 31, 1986, identified as the "Engelhard I Annual Report, 1985–1986". As described in this report, samples were prepared with nominal compositions of $Pt_{50}Co_{50}$, $Pt_{47.5}Co_{47.5}B_5$, and $Pt_{45}Co_{45}B_{10}$. The samples melted at the top of a vacuum tube and dropped down the tube for cooling by radiation. Some of the $Pt_{45}Co_{45}B_{10}$. The samples were splat-quenched, that is, the still molten sample impacted a copper plate at the bottom of the vacuum tube to form a splat. The copper plate removed heat from one side of the splat to provide a higher cooling rate than tube cooling alone. After annealing the splat-quenched samples at 600°–650° C., a maximum intrinsic coercivity ($H_{ci}$) of around 4.5 kOe was observed after 15 minutes of heat treatment. Coercivity values declined as the heating was continued. By way of comparison, as shown in FIG. 4 on page 38 of the Report, the $Pt_{50}$-$Co_{50}$ sample produced by an undercooling procedure gave a maximum coercivity of about 6.7 kOe after heat treatment under the same conditions (viz. 15 minutes at 600°–650° C.).

SUMMARY OF INVENTION

This invention is based on discoveries made at the Vanderbilt University Center for the Space Processing of Engineering Materials subsequent to the research described in the 1985–1986 Report (cited above). Magnetic alloys formed from platinum (Pt), cobalt (Co), and boron (B), having the general formula PtCoB, were further investigated. In accordance with known practice, test alloy samples were formed by rapid solidification of a homogenous melt to form a casting, and the solidified casting was heat treated to improve its microstructure and to increase coercivity. The relative amounts of Pt, Co, and B were varied. It was discovered that the atomic percent boron and the atomic ratio of platinum to cobalt are both critical for maximizing intrinsic coercivity of rapidly cooled and heat treated castings. More specifically, it was found that intrinsic coercivities in the range of 12 to 14 kOe could be obtained with alloys containing 12 to 14 atomic percent boron and a Pt/Co atomic ratio of 0.90 to 1.1. An optimized alloy containing 13% B and a Pt/Co ratio of 0.93 achieved an intrinsic coercivity of 14 kOe. The normal formation of this lloy is $Pt_{42}Co_{45}B_{13}$. Coercivities of 12 to 14 kOe represent a marked enhancement of this important property over the values previously obtained with platinum-cobalt magnets. Such a degree of coercivity enhancement was unexpected for PtCoB alloys in view of the initial results described above in which a $Pt_{50}Co_{50}$ sample gave a higher intrinsic coercivity (6.7 kOe) than a splat-quenched $Pt_{45}Co_{45}B_{10}$ sample (4.5 kOe).

THE DRAWINGS

The accompanying drawings are graphical presentations of experimental data relating to the invention. FIG. 1 is a plot of intrinsic coercivity vs. annealing temperature for varying compositions of PtCoB alloys; and FIG. 2 is a plot of intrinsic coercivity vs. Pt/Co ratio for varying PtCoB alloy compositions.

DETAILED DESCRIPTION

Figure 1:
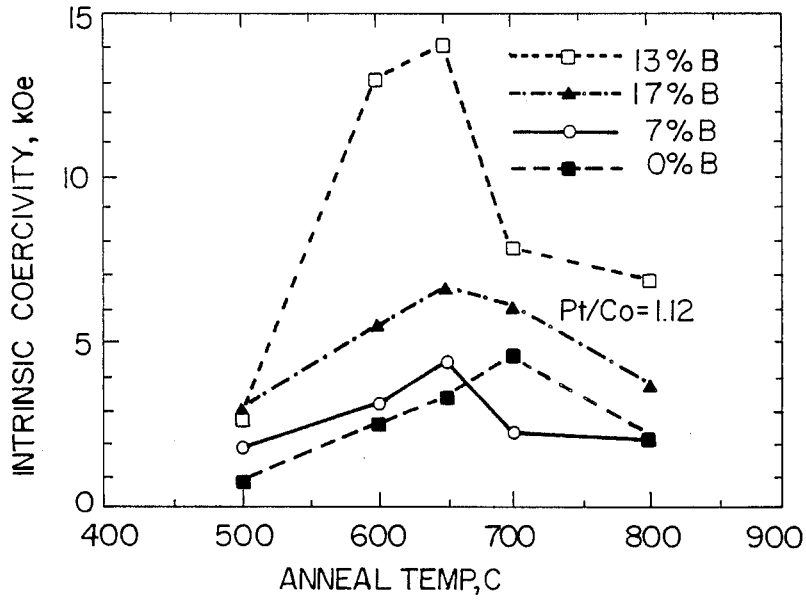

The principal object of this invention is to improve the coercivity of platinum-cobalt alloys as employed for permanent magnets. Coercivity is that property of a magnetic material which is measured by the coercive force when the induction is driven to zero by a reverse magnetic field after the material has been fully saturated. The intrinsic coercivity ($H_{ci}$) is the demagnetizing force at which the intrinsic induction is driven to zero.

Platinum-cobalt magnetic alloys containing approximately equal atomic amounts of platinum and cobalt are commercially important magnets because of their desirable properties, but they have heretofore exhibited relatively low coercivities. It is recognized that the coercivities of these alloys can be increased by rapid cooling of the alloy melt in forming the casting or ingot, and that some further improvement in coercivity can be obtained by heat treatment. The intrinsic coercivity of such magnetic alloys is believed to be related to an effect called "domain wall pinning", which is due to high crystal anisotropy of crystallites of ordered FCT material in a disordered FCC matrix. It is believed desirable to employ a strongly segregating alloy system to effect the size and/or distribution of the FCT crystallites.

The general formula of the alloys of this invention is:

$Pt_xCo_yB_z$

In this formula, the letters x, y, and z represent atomic amounts of the metals, platinum (Pt), cobalt (Co), and boron (B). In accordance with the present invention, intrinsic coercivity of the PtCoB alloy can be maximized when the alloy contains from 12 to 14 atomic percent boron (z=12-14). The ratio of platinum to cobalt (Pt/Co; X/2) can be from 0.90 to 1.1. In preferred embodiments, however, the amount of platinum is slightly less than the amount of cobalt, viz. $Pt_{42}Co_{45}$. A preferred Pt/Co ratio is from 0.91 to 0.95, and an optimized ratio is 0.93. The preferred atomic percent of boron is 12.5 to 13.5, and an optimized amount of boron is 13 atomic percent. A nominal formula of the alloy which is believed to be the best mode of practicing the invention is $Pt_{42}Co_{45}B_{13}$.

The magnetic alloys of this invention are preferably prepared from elemental substantially pure platinum, cobalt and boron. For example, these metals may be employed in purities of 99.9 or greater. To facilitate the formation of an intimate mixture, metal components may be prepared in finely divided condition, such as by fine grinding. For example, particle sizes in the range from 50 μm to 100 μm are desirable. Exact atomic amounts of the powdered metals are mixed to homogeneity. To avoid any tendency of the metals to segregate during handling or melting, the homogeneous mixture of the powdered metals may be sintered. This may be accomplished, for example, by heating the powdered mixture to around 1000° C.

The mixed elements, either as a loose powder or in sintered form, are melted to produce a homogeneous alloy melt. The melted alloy is cast to form bar-shaped ingots, or magnetic components of other shapes. In forming the castings, it is desirable to subject the melt to rapid solidification. For example, a melt spinner may be employed. In this procedure, the alloy is inductively melted and ejected onto a rotating metallic wheel where it is solidified extremely rapidly. Other procedures for rapid solidification may be employed, such as melt atomization by gas jet or melt extraction. In melt atomization by gas jet, a molten metal stream is broken up into a finely divided spray of metal droplets approximately 50-200 μm in diameter. These very small metal droplets cool rapidly by radiation and convection and thus solidify very rapidly. Melt extraction is similar to melt spinning but utilizes a rapidly rotating metal disc that just touches the surface of a molten alloy. That portion of the molten alloy in contact with the wheel solidifies very rapidly and is extracted from the melt by the wheel's momentum.

After the casting or ingot has been formed by rapid cooling, as described above, it is subjected to a heat treatment, sometimes referred to as annealing or aging. This treatment may be carried out at temperatures from about 550° to 750° C. However, the preferred temperature range for annealing is from 600° to 700° C., such as around 650° C. This heat treatment can be carried out in from 15 to 45 minutes, such as for about 30 minutes. Under these conditions the heat treatment improves the microstructure of the casting and increases coercivity of the alloy.

For the commercial manufacture of large magnets from the alloys of this invention, standard manufacturing procedures may be employed. In general, a suitable manufacturing procedure uses the steps of compositional blending, sintering, melting, rapid solidification, pulverizing, hot pressing, and magnetization. The compositional blending, sintering, melting and rapid solidification procedures will occur as described above. The ribbons and ribbon fragments (if made by melt spinning or melt extraction) are subjected to pulverizing by means of a ball mill, vibratory mill, or jet mill to reduce the materials to a powder of approximately 50 μm in size. The resulting powder is then placed in a die that has been preheated to 700°-800° C. and then compressed to nearly full density by applying a pressure of 70-200 MPa for 1-3 minutes. The large magnet body is then ejected from the die and cooled to room temperature. The hot press procedure is similar to the hot pressing that General Motors uses to manufacture "Magnequench" permanent magnets from rapidly solidified ribbons of iron-neodymium-boron (See Lee, et al., *IEEE Transactions on Magnetics*, 1985, MAG-21, 1958). A significant increase in coercivity will occur as a result of the Pt-Co-B alloy being exposed to the 700°-800° C. hot pressing temperature, and for some applications, no additional heat treatment is necessary. However, depending upon the ultimate application and the exact hot press temperature/time cycle, an additional heat treatment at 600°-700° C. may be needed to optimize coercivity values. Any secondary machining operations to satisfy geometrical requirements can utilize standard manufacturing techniques after which the large magnet is magnetized in a commercially available magnetizing facility.

EXPERIMENTAL BASIS OF INVENTION

Procedure

Laboratory ingots of the various compositions were prepared by arc melting previously sintered powdered compacts that had been blended to the proper compositions. The arc melting was accomplished under argon and was repeated a minimum of five times. The casting or ingot was flipped over after each melting cycle to assure compositional homogeneity.

Portions of each ingot were then vacuum induction melted and rapidly quenched using the double-anvil technique. Specimens from each "splat" were aged for 30 minutes at temperatures from 400° to 850° C., and then pulse magnetized in a 3 μms, 50 kOe field. Magnetic hysteresis loops were measured with a vibrating sample magnetometer. The polished and aqua regia etched samples' microstructures were observed with a Hitachi X-650 scanning electron microscope. Splat quenched and heat treated samples were also examined with JEOL 200CS and Philips EM 420T transmission electron microscopes. All samples were ion beam thinned prior to transmission electron microscopy.

Results

The intrinsic coercivities of as-splatted samples of three alloys of 7, 13, and 17 atomic percent of boron (Pt/Co=0.93) were only 200-500 Oe. Heat treating the splats at 400°-850° C. significantly increased the intrinsic coercivities as shown in FIG. 1. A broad peak in $H_{ci}$ is seen at temperatures from approximately 600°-700° C. for all these alloys. The 13 atomic percent boron alloy exhibited the largest intrinsic coercivity of about 14 kOe. Larger amounts of boron, i.e., 17%, were not as effective in producing large $H_{ci}$.

Figure 2:
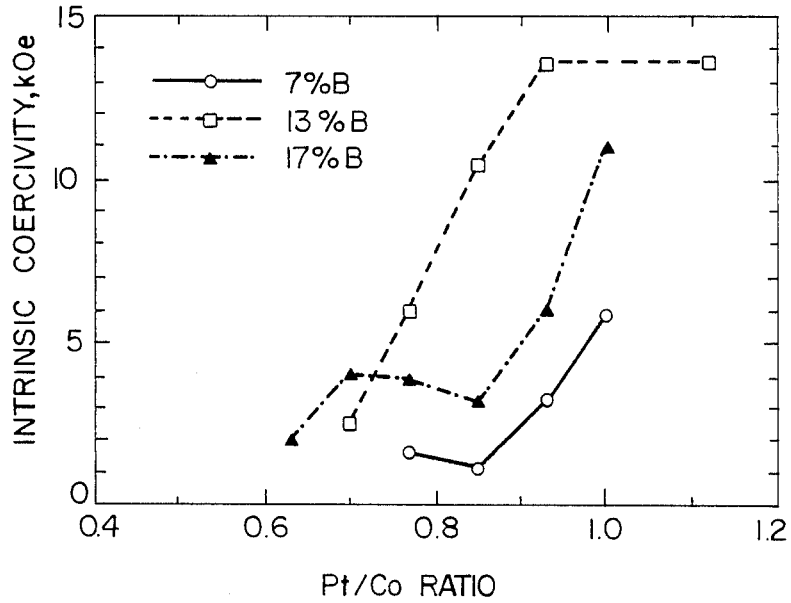

FIG. 2 shows the effect of the ratio of Pt/Co (up to a Pt/Co ratio of 1.12) on intrinsic coercivity after heat treating at 650° C. for 30 minutes. The general trend is for $H_{ci}$ to increase as the Pt/Co ratio increases from 0.6 to 1.0. The 13 atomic percent boron alloys showed the largest coercivities for most of the Pt/Co ratios investigated, achieving a maximum of about 14 kOe in the Pt/Co range from 0.9 to 1.1.

Samples of splatted and heat treated $Pt_{42}Co_{45}B_{13}$ were metallographically mounted, polished, and etched for observation of their microstructures in the scanning electron microscope. The samples examined were (1) as splatted, (2) splatted and heat treated at 650° C. for 30 minutes, and (3) splatted and heat treated at 800° C. for 30 minutes. All micrographs showed significant etching of a second phase apparently along grain boundaries. The microstructure of the as-splatted sample exhibited an apparent grain size of about 0.5–1 μm. Heat treating at the optimum 650° C. coarsened the structure so that the apparent grain size increased to about 3 μm. The sample heat treated at 800° C. exhibited an even larger apparent grain size of about 5 μm.

Discussion

The addition of boron appears to change the solidification mode from columnar dendritic for PtCo alloys to equiaxed from PtCoB alloys, as represented by the $Pt_{42}Co_{45}B_{13}$ alloy, where the equiaxed grains produced were approximately 0.5–1.0 μm. Heat treating the rapidly solidified samples at 650° C. causes some grain growth and yields a fine scale precipitation of the ordered FCT phase in the disordered FCC matrix. The boron containing alloys of this invention can exhibit $H_{ci}$ as large as 14 kOe. Their grain sizes are approximately equal to calculated magnetic single domain particle size of 1–3 μm.

We claim:

1. A magnetic alloy in a structural form providing magnetic properties, said alloy being formed from platinum (Pt), cobalt (Co), and boron (B) and having the general formula PtCoB, the magnetic properties of said structural alloy having been produced by rapid solidification of a homogenous melt of said alloy to form a casting and by heat treatment of the solidified casting to improve its magnetic microstructure and increase coercivity, wherein the improvement comprises having present in said alloy from 12 to 14 atomic percent of boron together with amounts of platinum and cobalt such that the atomic ratio of platinum to cobalt (Pt/Co) is from 0.90 to 1.1.

2. The magnetic alloy of claim 1 in which the Pt/Co ratio is from 0.91 to 0.95.

3. The magnetic alloy of claim 1 in which the Pt/Co ratio is 0.93.

4. The magnetic alloy of claim 1 in which said alloy contains from 12.5 to 13.5 atomic percent boron.

5. The magnetic alloy of claim 1 in which said alloy contains 13 atomic percent boron.

6. A magnetic alloy in a structural form providing magnetic properties, said alloy being formed from platinum (Pt), cobalt (Co), and boron (B) and having the general formula PtCoB, the magnetic properties of said structural alloy having been produced by rapid solidification of a homogenous melt of said alloy to form a casting and by heat treatment of the solidified casting is to improve its magnetic microstructure and increase coercivity, wherein the improvement comprises having present in said alloy from 12.5 to 13.5 atomic percent of boron together with amounts of platinum and cobalt such that the atomic ratio of platinum to cobalt (Pt/Co) is from 0.91 to 0.95.

7. A magnetic alloy in a structural form providing magnetic properties, said alloy being formed from platinum (Pt), cobalt (Co), and boron (B) and having the general formula PtCoB, the magnetic properties of said structural alloy having been produced by rapid solidification of a homogenous melt of said alloy to form a casting and by heat treatment of the solidified casting is to improve its magnetic microstructure and increase coercivity, wherein the improvement comprises having present in said alloy 13 mole percent of boron together with amounts of platinum and cobalt such that the mole ratio of platinum to cobalt is 0.93.

* * * * *